US008192593B2

(12) United States Patent
Penn

(10) Patent No.: US 8,192,593 B2
(45) Date of Patent: Jun. 5, 2012

(54) ELECTRICAL ISOLATION OF VEHICLE BODY CARRIERS

(75) Inventor: Mark Penn, Anniston, AL (US)

(73) Assignee: Honda Motor Co., Ltd., Tokyo (JP)

( * ) Notice: Subject to any disclaimer, the term of this patent is extended or adjusted under 35 U.S.C. 154(b) by 597 days.

(21) Appl. No.: 12/410,546

(22) Filed: Mar. 25, 2009

(65) Prior Publication Data

US 2010/0243433 A1 Sep. 30, 2010

(51) Int. Cl.
*C25D 17/00* (2006.01)

(52) U.S. Cl. ..... 204/198

(58) Field of Classification Search ..... 204/198, 204/227

See application file for complete search history.

(56) References Cited

U.S. PATENT DOCUMENTS

| | | | | |
|---|---|---|---|---|
| 2,070,343 | A * | 2/1937 | Turnock | 204/229.8 |
| 2,944,953 | A | 7/1960 | Borodin | |
| 3,328,512 | A * | 6/1967 | Lembke et al. | 174/72 R |
| 3,476,667 | A | 11/1969 | Gilchrist | |
| 3,860,509 | A * | 1/1975 | Emmett, Jr. | 204/281 |
| 4,263,122 | A | 4/1981 | Urquhart | |
| 4,668,358 | A | 5/1987 | Ball | |
| 4,904,365 | A | 2/1990 | Kawamura et al. | |
| 6,391,180 | B1 | 5/2002 | Brendel et al. | |

FOREIGN PATENT DOCUMENTS

| | | |
|---|---|---|
| JP | 10-18087 A | 1/1998 |

* cited by examiner

*Primary Examiner* — Luan Van
(74) *Attorney, Agent, or Firm* — Standley Law Group LLP

(57) ABSTRACT

A technique for electrically isolating a vehicle body carrier from a vehicle body during an electrode position coating process, and a vehicle body carrier that has been so electrically isolated. Points of potential charge transfer to the vehicle body carrier are preferably isolated. Electric current is routed to a vehicle body on the carrier by means of a conductor cable that preferably runs through the hollow interior of at least one vehicle carrier support member to a conductive vehicle body support component, thereby electrically charging the vehicle body. The retention component and other conductive points of contact between the vehicle body and the vehicle body carrier are isolated to prevent charge transfer. In this manner, the vehicle body carrier will not attract e-coat during the electrode position process and, therefore, will not experience a buildup of e-coat material.

23 Claims, 6 Drawing Sheets

ELECTRICAL ISOLATION OF VEHICLE BODY CARRIERS

BACKGROUND OF THE INVENTIVE FIELD

The present invention is directed to a technique for isolating a vehicle body carrier from an electrically charged vehicle body, and to vehicle body carriers employing such an electrical isolation technique. More particularly, the present invention is directed to a technique for isolating a vehicle body carrier from an electrically charged vehicle body, such that electrodeposition coating materials will not be attracted to and adhere to the vehicle body carrier.

Electrodeposition coating is well known in automotive and other vehicle manufacturing industries and, therefore, need not be described in detail herein. Basically, however, an electrically charged material (e-coat material) is coated to a vehicle body by imparting the vehicle body with a DC electrical charge that is opposite to that of a DC electrical charge imparted to the e-coat material. Consequently, when the vehicle and e-coat material are placed into contact (or near contact, in some cases), the e-coat material is attracted to and deposits on the oppositely-charged vehicle body. Such e-coat materials are generally applied to a vehicle body prior to primers (if used) and paints (often referred to as "white body" stage) to provide the vehicle body with improved corrosion resistance.

As considered in the present invention, electrodeposition coating is typically accomplished by immersing an unfinished vehicle body in a bath (tank) containing the e-coat material. With the vehicle body immersed in the tank of e-coat material, electric current is passed through both the vehicle body and e-coat material as described above. The e-coat material in contact with the vehicle adheres to the vehicle surface, building up an electrically insulating e-coat material layer over all areas of the vehicle body. Electrodeposition coating of a vehicle body is typically followed by passing the vehicle body through, for example, a rinsing operation and an oven.

In a vehicle manufacturing environment, the electrodeposition coating process typically occurs with the vehicle body attached to an assembly line conveyor vehicle body carrier. Therefore, both the vehicle body and vehicle body carrier are immersed in the e-coat tank during the electrodeposition coating process.

Subjecting the vehicle body carrier to an e-coat bath is generally problematic, however. That is, as described above, successfully coating an e-coat material to a vehicle body requires that the vehicle body be electrically charged. Because the carrier on which the vehicle body is supported during the electrodeposition coating process is moving, commonly on an overhead conveyor system, the required electrical charge is generally provided to the vehicle body from a bus, etc., associated with the overhead conveyor system. As the vehicle body and vehicle body carrier are commonly in conductive contact, the vehicle body carrier is also electrically charged, and of the same polarity as the vehicle body. This means, of course, that the vehicle body carrier will attract e-coat material in the same manner as the vehicle body while immersed in the e-coat bath.

This is an undesirable side effect of the electrodeposition coating process because long-term buildup of e-coat material on a vehicle body carrier may cause various problems. For example, such vehicle body carriers normally include various structures and components designed to interact with and to secure a vehicle body to the carrier. Excessive buildup of e-coat material on these structures and components can interfere with proper engagement between a vehicle body carrier and a vehicle body. The long-term buildup of e-coat material on a vehicle body carrier can also add significant weight to the vehicle body carrier, thereby imparting increased stresses on associated carrier support structures, drive systems, etc. Obviously, a buildup of e-coat material on a vehicle body carrier is also wasteful, as such material is intended for deposition only on an associated vehicle body, and the e-coat material cannot be reused once electrodeposited even if removed.

Consequently, based on the foregoing discussion, it can be understood that it would be desirable to prevent or at least greatly reduce the amount of e-coat material that adheres to a vehicle body carrier during the electrodeposition coating process. The technique and a resulting vehicle body carrier of the present invention allows for such a result.

SUMMARY OF THE GENERAL INVENTIVE CONCEPT

The present invention is directed to a technique for electrically isolating a vehicle body carrier from a vehicle body during the electrodeposition coating process, and to a vehicle body carrier that has been so electrically isolated. Thus, a vehicle body carrier that has been electrically isolated according to the present invention, will not experience the buildup of e-coat material commonly suffered by known and non-isolated vehicle body carriers.

A vehicle body carrier of the present invention is generally contemplated as being movably suspended from an overhead conveyor system, although other conveying techniques are certainly possible. A vehicle body carrier of the present invention is also generally contemplated as including at least one substantially hollow support member that extends with some shape from a point near connection to the conveyor system to a point of support beneath a vehicle to be carried thereby (although such a support member design is not critical). Typically, but not necessarily, such a vehicle body carrier will include more than one such support member.

The method of conducting electric current from a source (such as a bus bar) to a moving vehicle body carrier would be understood by one of skill in the art. Therefore, a detailed description of the electric current transfer mechanism is not provided herein.

Isolated conduction of electric current from a source transference point to a vehicle body residing on a vehicle body carrier is, however, a concern of the present invention. In that regard, a current conducting cable is routed from a bus strap or similar source current conductor appropriately on a vehicle body carrier, through one or more previously described hollow support members, and to one or more support components that extend from a vehicle supporting portion of the vehicle body carrier to contact and support a vehicle. At each point where the current conducting cable does, or may, come in contact with a substantially hollow support member, the cable is prevented from conducting electric current thereto.

The conducting cable is routed through the substantially hollow support member to a termination point in conductive contact with the vehicle body. For example, the cable may be connected to one or more vehicle support components that will be used to conduct the electric current to the vehicle body. In this case, it is generally not necessary, or desirable, to connect the conducting cable to every vehicle support component or other support structure of a vehicle body carrier, but such may be done. In addition to the vehicle support components that will be used to conduct the electric current to the vehicle body, all other conductive vehicle support components and/or other structures of a vehicle body carrier that will contact a vehicle body when present are also electrically isolated at the point of attachment to the remainder of the vehicle body carrier. This electrical isolation prevents electric current from being transferred from the vehicle body back to the vehicle body carrier through a vehicle support component or other vehicle contacting structure comprised of a conducting material.

Such electrical isolation requires not only that said vehicle support components and other vehicle contacting structures be isolated, but also that all fasteners and other conducting elements that would otherwise transfer an electric charge from a vehicle body back to a carrier be isolated. Such electrical isolation may be accomplished in various ways end by means of various materials, each of which will be discussed in more detail below.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
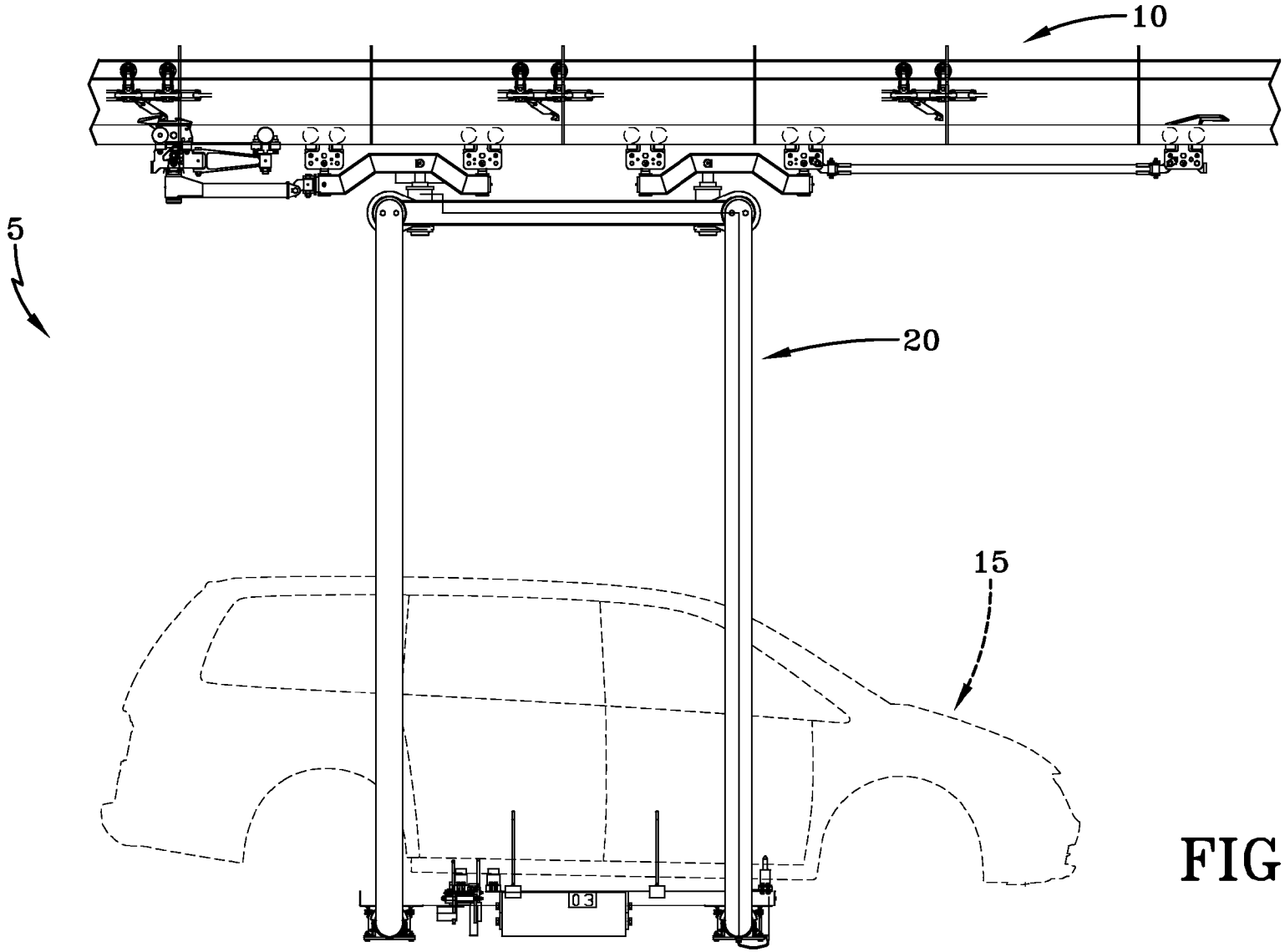
FIG. 1 is a side elevation view depicting one exemplary vehicle body carrier of the present invention, the carrier suspended from an overhead conveyor and supporting a vehicle that will be immersed in an e-coat bath.

A portion of an exemplary vehicle body conveying system 5 is illustrated in FIG. 1. As shown, the conveying system 5 includes an overhead conveyor 10 to which is coupled a multitude of vehicle body carriers 20 (only one of which is shown in FIG. 1). A vehicle body 15 is carried by the vehicle body carrier 20. The conveying system 5 is operative to transport vehicle bodies 15 along a predetermined path. With respect to the present invention, the conveying system 5 is operative to move vehicle bodies through at least one electrodeposition coating bath (not shown)

Figure 2:
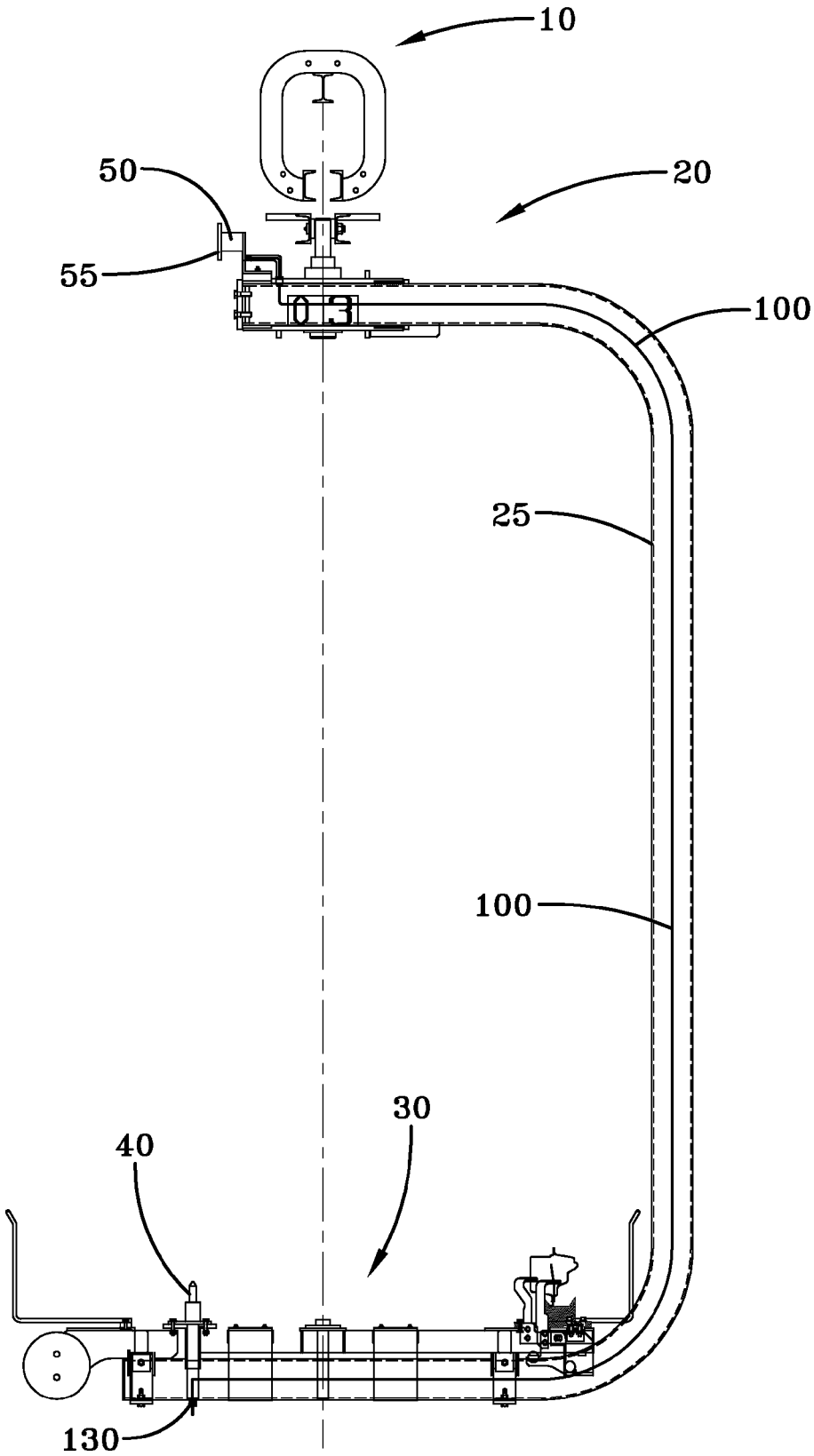
FIG. 2 is a front elevation view of the vehicle body carrier of FIG. 1.
Figure 3:
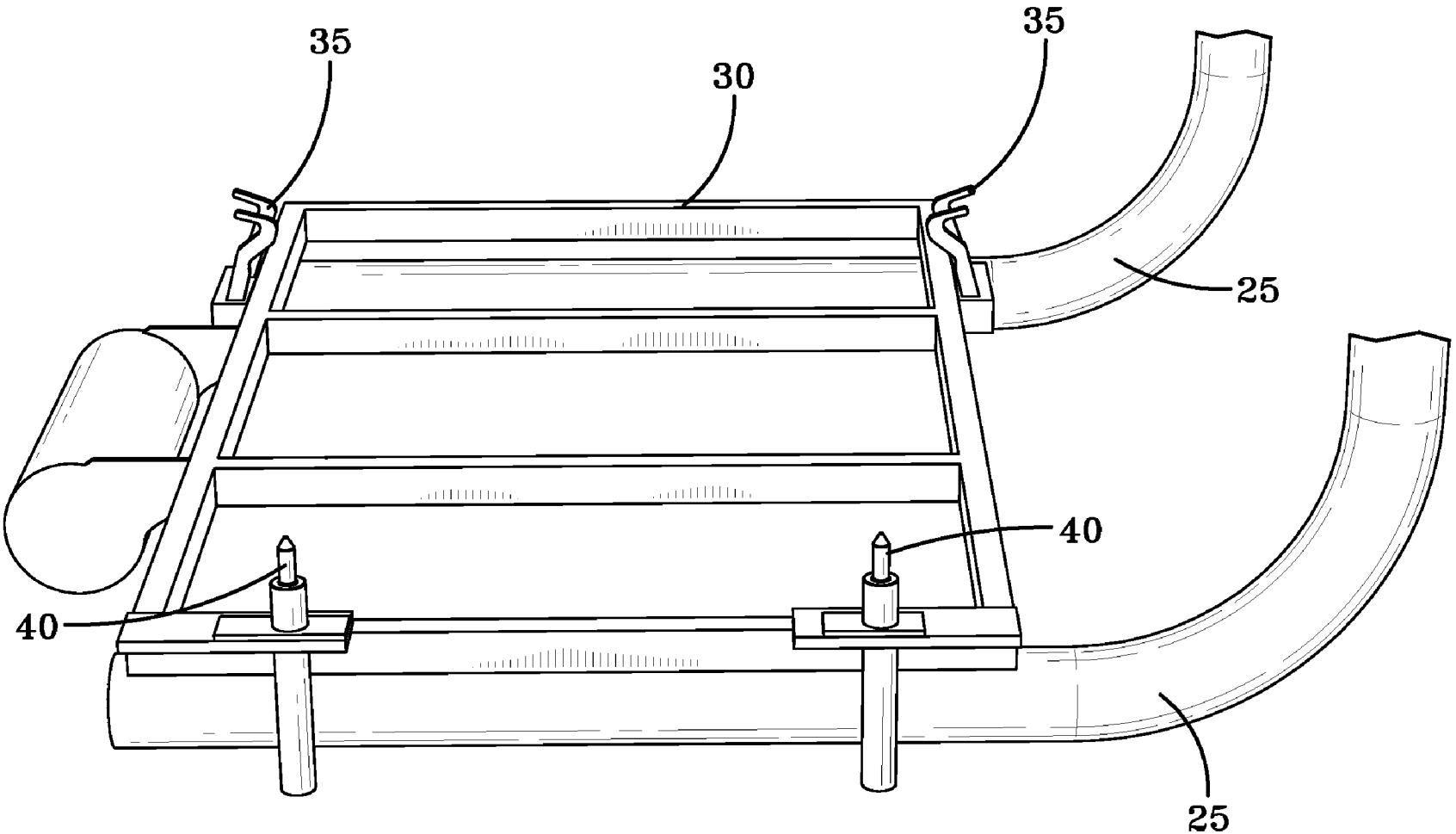
FIG. 3 is a front perspective view of a vehicle support portion of the vehicle body carrier of FIG. 1.

As can be observed in FIGS. 1-3 the exemplary vehicle body carrier 20 comprises a framework of interconnected frame members. These frame members are shown to include a pair of hollow and substantially C-shaped primary support members 25 that extend substantially from a point of connection with the overhead conveyor system 10 to a point of support beneath the carried vehicle body 15. As can be best observed in FIG. 3, a substantially rectangular-shaped vehicle support framework 30 is mounted to and interconnects the primary support members 25 along the area of the vehicle body carrier 20 that resides below the carried vehicle 15.

Referring still to FIG. 3, it can be seen that the vehicle support framework 30 contains several vehicle body support/retention components. For example, a pair of vehicle body retention clamps 35 are attached to the vehicle support framework 30 near a rear section thereof. Similarly, an upwardly extending pair of vehicle support and retention pins 40 are fixed to the vehicle support framework 30 near a front portion thereof. These vehicle body support and retention components 35, 40, act to support and retain the vehicle body 15 on the vehicle body carrier 20 as the carrier moves along the overhead conveyor 10 and through an electrodeposition coating bath.

Figure 4:
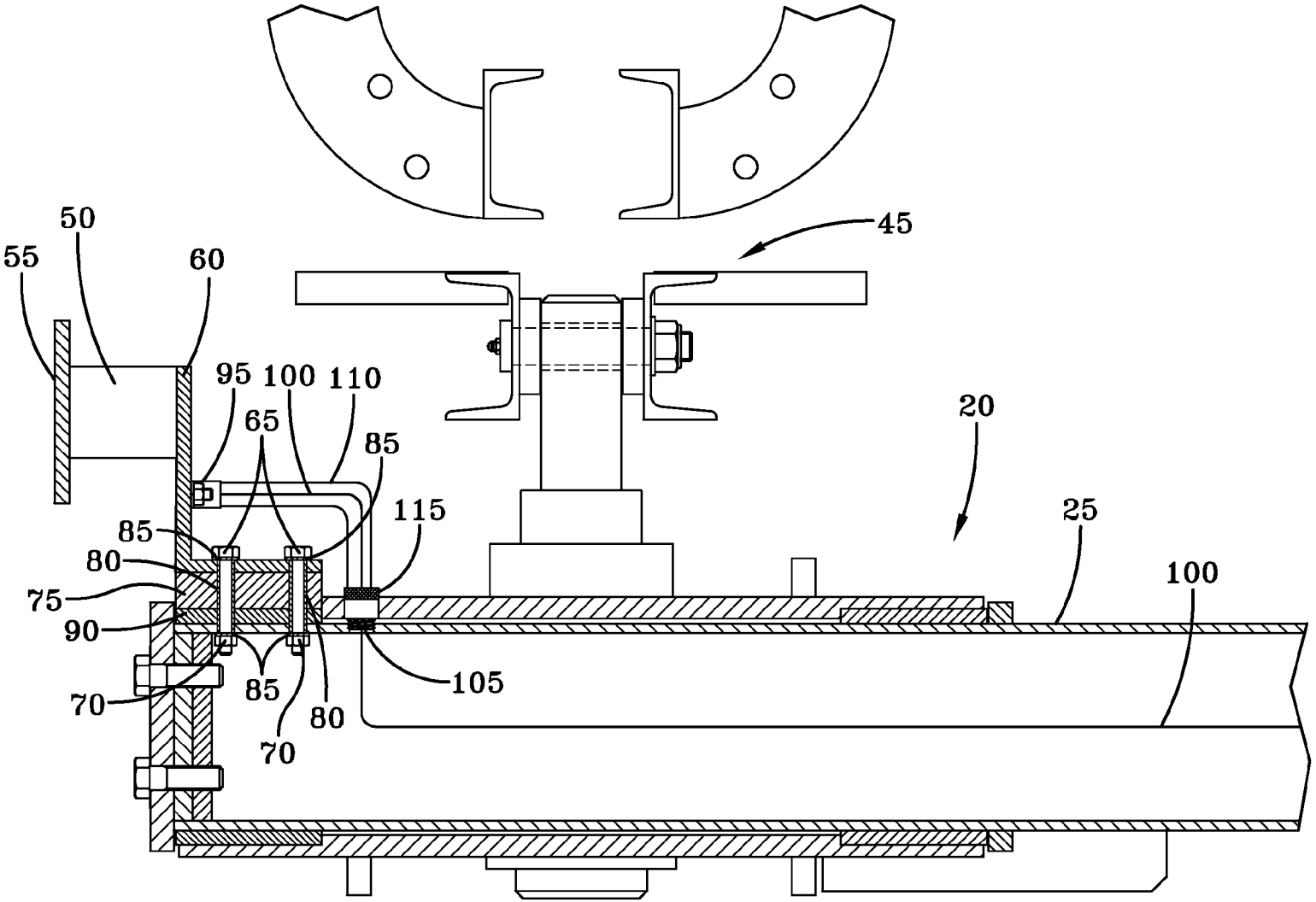
FIG. 4 is an enlarged detail view of a top portion of the vehicle body carrier as shown in FIG. 2.

Referring now to FIG. 4, an enlarged view of an upper section of the vehicle body carrier 20 may be observed. Connection of the vehicle body carrier 20 to the overhead conveyor 10 is represented at 45. As previously described, the electric current for electrically charging the vehicle body 15 is provided by contacting a bus strap 50 associated with the vehicle body carrier 20 with a bus bar 55 or similar supply mechanism associated with the overhead conveyor 10.

As seen in FIG. 4, the bus strap 50 is associated with a bus strap bracket 60 that would typically electrically connect the bus strap 50 to the vehicle body carrier 20. The bus strap bracket 60 is shown to be affixed to the vehicle body carrier 20 by means of several threaded fasteners 65 and associated nuts 70. Consequently, the vehicle body carrier 20 would typically be placed in electrical communication with the bus bar 55 such that the vehicle body carrier would become electrically charged.

In the present invention, however, it can be seen that the bus strap bracket 60 is electrically isolated from the vehicle body carrier 20 by an isolator block 75. Further electrical isolation is also provided by an isolation sleeve 80 that surrounds the body of each threaded fastener 65, and an isolation washer 85 that underlies each nut 70 and the head of each threaded fastener. In this manner, the bus strap bracket 60 as well as the fasteners 65 and their associated nuts 70, are electrically isolated from the vehicle body carrier 20 and the bus strap bracket attachment plate 90 affixed thereto. As such, the vehicle body carrier 20 is not electrically charged by way of the electric current flowing from the bus bar 55 through the bus strap bracket 60.

As previously described, the vehicle body 15 carried by the vehicle body carrier 20 must be electrically charged in order to attract e-coat material when immersed in the electrodeposition coating bath. Therefore, electrical current must be routed from the bus bar 55 to the vehicle body 15.

As depicted in FIG. 4, the bus strap bracket 60 is provided with a bus connecting lug 95 to which may be connected a conductor cable 100 for transmitting electrical current from the bus bar 55 to the vehicle body 15. The conductor cable 100 is connected to a bus connecting lug 95 by any suitable connector. The conductor cable 100 is routed from the bus connecting lug 95 through an entry aperture 105 in one of the primary support members 25. In other embodiments where it is not possible to route a conductor cable internally to a carrier support member, it may be possible to route a conductor cable along the exterior of the carrier frame using, if necessary, appropriate electrical isolation techniques such as those described below.

Preferably, the exposed portion of the conductor cable 100 residing between the bus connector lug 95 and the primary support member 25 is encased within an insulating sheath 110 or a similar non-conducting cover. Preferably, the aperture 105 in the primary support member 25 is also provided with an insulated compression fitting 115 or similar element to isolate the conductor cable 100 from the wall of the primary support member 25 as it passes through the aperture and to guard against wear of the cable shielding (casing) material. In this manner, it can be ensured that, the conductor cable 100 extends from the bus connector lug 95 into the hollow interior of the primary support member 25 without conducting electric current to the vehicle body carrier 20.

Figure 5:
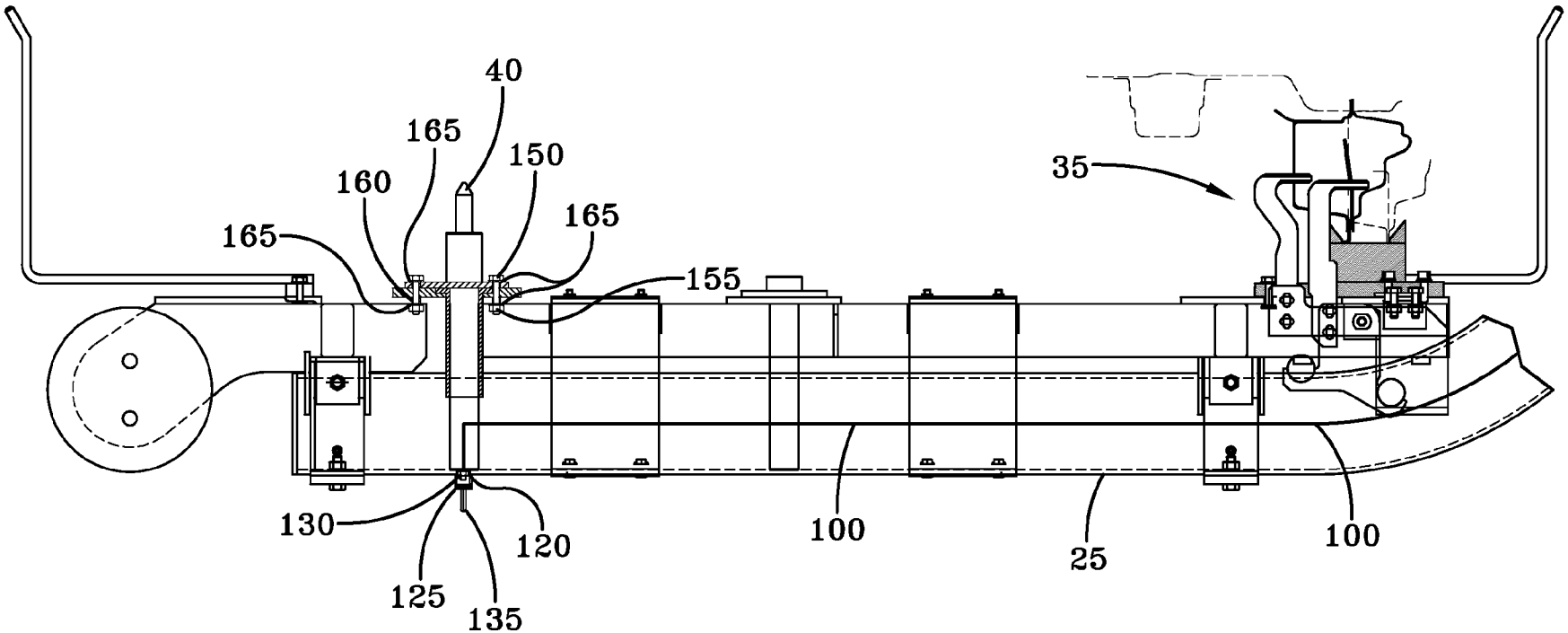
FIG. 5 is an enlarged detail view of a lower support portion of the vehicle body carrier as shown in FIG. 2.
Figure 6:
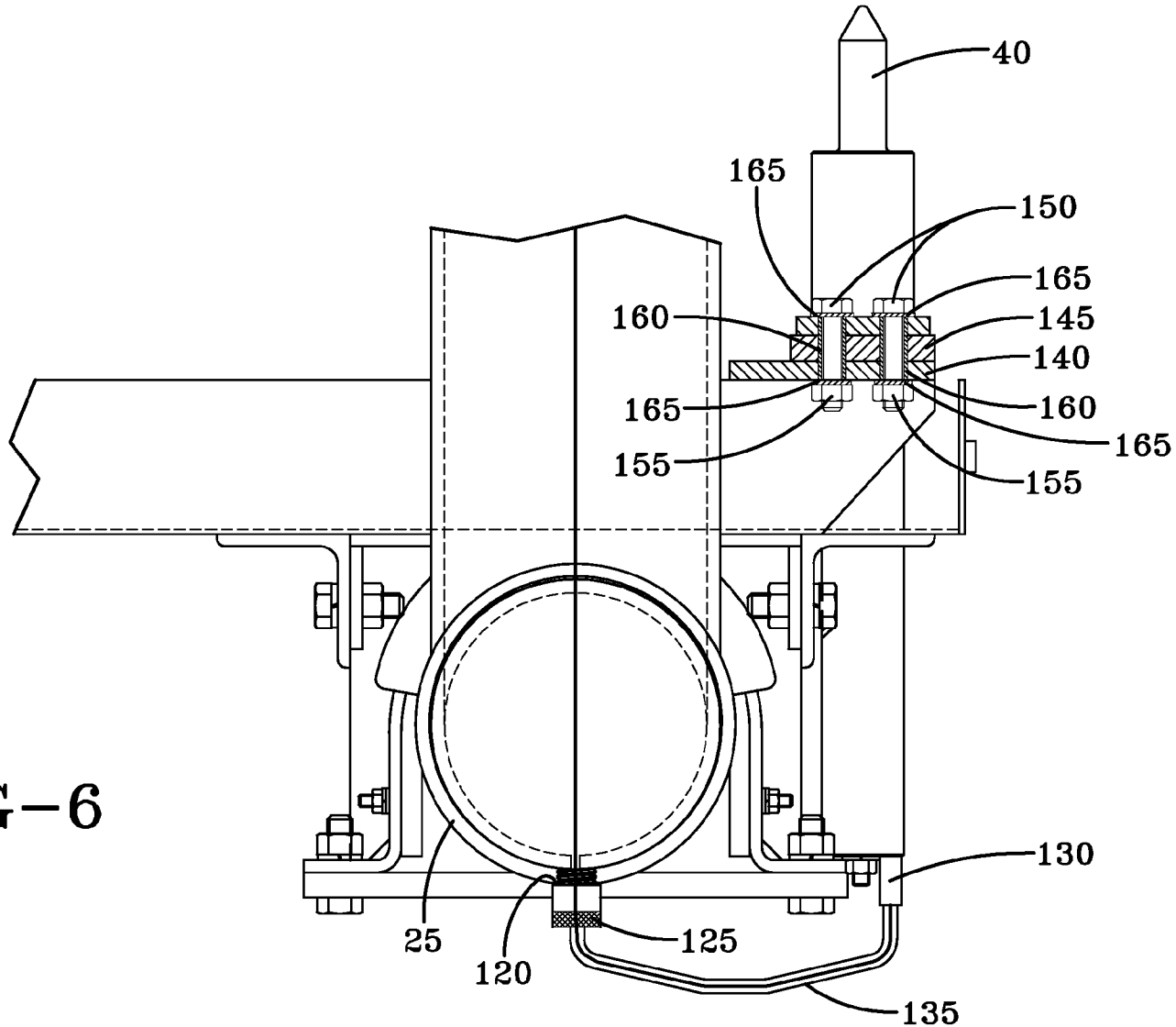
FIG. 6 is a side elevation view of the enlarged detail section shown in FIG. 5.

Referring now to FIG. 2 and to FIGS. 4-6, it can be observed that the conductor cable 100 travels through the hollow interior of the primary support member 25 and exits therefrom via an exit aperture beneath the vehicle support framework 30. As with the entry aperture 105 where the conductor cable 100 enters the primary support member 25, the exit aperture 120 is preferably provided with an insulated compression fitting 125 or similar element to isolate and protect the conductor cable 100 from the wall of the primary support member 25 as it passes through the exit aperture. As the lower part of the vehicle body conveyor 20 is submerged in the electrodeposition coating bath during the e-coat process, such a compression fitting 125 may also function to prevent entry of the e-coat material into the interior of the primary support member(s) 25.

Upon exiting the primary support member 25, the conductor cable 100 runs to and terminates at a terminal lug 130 associated with, in this particular embodiment, one of the vehicle support and retention pins 40. In other embodiments of a vehicle body carrier of the present invention, a conductor cable may be connected to one or more other vehicle contacting support/retention elements, or may be connected to a vehicle in another manner (e.g., via a clamp or fastener). In any event, the exposed portion of the conductor cable 100 located between the exit aperture 120 and the terminal lug may again be encased within an insulating sheath 135 or a similar non-conducting cover.

The vehicle support and retention pin 40 is electrically charged by connection to the conductor cable 100. Therefore, in order to prevent the transfer of electric charge from the vehicle support and retention pin 40 to the vehicle body carrier 20, the vehicle support and retention pin must be isolated from the vehicle body carrier in a manner similar to that of the bus bar bracket 60. To that end, a vehicle support and retention pin 40 is separated from a retention pin mounting plate 140 associated with the vehicle body carrier 20 by an isolator block 145 (see FIG. 6). As previously described with respect to the bus bar bracket 60, the bodies of the threaded fasteners 150 and associated nuts 155 used to secure the vehicle support and retention pin 40 to its mounting plate 140 are electrically isolated by an isolation sleeve 160 that surrounds the body of each threaded fastener 150, and an isolation washer 165 that underlies each nut 155 and the head of each fastener. Consequently, the vehicle body carrier 20 remains uncharged even though electric current flows through the vehicle support and retention pin 40.

As would be understood by one of skill in the art, the vehicle support and retention pins 40 are conductively engaged within corresponding apertures in the vehicle body 15 when the vehicle body resides on the vehicle body carrier 20. Therefore, the electric current flowing through the vehicle support and retention pin 40 is transferred to the vehicle body 15, causing the vehicle body to become electrically charged as required to attract e-coat material when immersed in an electrodeposition coating tank.

Based on the foregoing description of isolating the vehicle body carrier 20 from points of possible electric charge transfer, and the general desire of maintaining a vehicle body carrier in an uncharged condition, one skilled in the art would also realize that any other conductive points of contact between the vehicle body 15 and the vehicle body carrier must typically be electrically isolated in a similar manner. For example, the vehicle body retention clamps 35 may be electrically isolated from the vehicle body carrier 20 using isolator blocks, sleeves, and other electrically isolating components as may be necessary. The same holds true for any other electrically conducting support structures connecting the vehicle body 15 to the vehicle body carrier 20. As the technique for electrically isolating such additional structures may be essentially the same or very similar to that described above, the electrical isolation thereof will not be described in further detail herein.

Various non-conducting materials may be used to construct the isolator blocks, isolator sleeves, isolator washers and/or other isolator elements used with the present invention. While in no way limiting the scope of isolator element materials that may be used, it has been found that an ultra high molecular weight (UHMW) plastic works particularly well for this purpose.

It is to be understood that the exemplary vehicle body carrier shown and described herein is provided for purposes of illustration only, and nothing herein is to be interpreted as limiting the present invention to use with this particular vehicle body carrier or the structure, construction or appearance thereof. Rather, it would be apparent to one of skill in the art that the technique of the present invention may be integrated into a variety of existing or yet-to-be designed vehicle body carriers of dissimilar structure, construction or appearance. Therefore, while one exemplary embodiment of the present invention is described in detail above, the scope of the invention is not to be considered limited by such disclosure, and modifications are possible without departing from the spirit of the invention as evidenced by the following claims:

What is claimed is:

1. An electrically isolated vehicle body carrier, comprising:

a carrier framework for supporting a vehicle body, said carrier framework connected to a conveyor;

a conductor member associated with said carrier framework, said conductor member in electrical communication with a source of electric current associated with a portion of said conveyor;

a conductor cable connected between said conductor member and a conductive point of contact with a vehicle body carried on said carrier framework; and isolator elements separating said carrier framework from conductive points of contact between said carrier framework and said vehicle body;

whereby, said vehicle body is electrically charged by said electric current without electrically charging said vehicle body carrier.

2. The vehicle body carrier of claim 1, wherein said carrier framework is suspended from an overhead conveyor.

3. The vehicle body carrier of claim 2, wherein said carrier framework includes at least one substantially hollow primary support member that extends substantially from a point of connection with said overhead conveyor to a point of support beneath a carried vehicle body.

4. The vehicle body carrier of claim 3, wherein said conductor cable is routed through said substantially hollow primary support member.

5. The vehicle body carrier of claim 1, further comprising a plurality of vehicle support/retention elements associated with said carrier framework for supporting and retaining a vehicle body on said carrier framework from a location beneath said vehicle body.

6. The vehicle body carrier of claim 5, wherein said conductor cable is connected to a support/retention element in conductive contact with a vehicle body carried on said carrier framework.

7. The vehicle body carrier of claim 6, wherein said support/retention element to which said conductor cable is connected is a pin that enters an aperture in a vehicle body carried on said carrier framework.

8. The vehicle body carrier of claim 5, wherein said support/retention elements are affixed to said carrier framework by threaded fasteners.

9. The vehicle body carrier of claim 8, wherein said threaded fasteners are electrically isolated from said carrier framework.

10. The vehicle body carrier of claim 1, wherein exposed portions of said conductor cable are encased in an electrically isolating cover.

11. The vehicle body carrier of claim 1, wherein said isolator elements are constructed of an ultra high molecular weight (UHMW) plastic.

12. An electrically isolated vehicle body carrier for transporting a vehicle body through an electrodeposition coating bath, comprising:

a carrier framework for supporting and retaining a vehicle body, said carrier framework suspended from an overhead conveyor;

a conductor member associated with said carrier framework, said conductor member in electrical communication with a source of electric current associated with a portion of said conveyor;

a conductor cable connected to said conductor member and routed along said carrier framework to a conductive point of contact with a vehicle body carried on said carrier framework; and isolator elements separating said carrier framework from conductive points of contact between said carrier framework and said vehicle body;

whereby, said vehicle body is electrically charged by said electric current without electrically charging said vehicle body carrier.

13. The vehicle body carrier of claim 12, wherein said carrier framework includes at least one substantially hollow primary support member that extends substantially from a point of connection with said overhead conveyor to a point of support beneath a carried vehicle body.

14. The vehicle body carrier of claim 13, wherein said conductor cable is routed through said substantially hollow primary support member.

15. The vehicle body carrier of claim 12, further comprising a plurality of vehicle support/retention elements associated with said carrier framework for supporting and retaining a vehicle body on said carrier framework from a location beneath said vehicle body.

16. The vehicle body carrier of claim 15, wherein said conductor cable is connected to a support/retention element in conductive contact with a vehicle body carried on said carrier framework.

17. The vehicle body carrier of claim 16, wherein said support/retention element to which said conductor cable is connected is a pin that enters an aperture in a vehicle body carried on said carrier framework.

18. The vehicle body carrier of claim 12, wherein exposed portions of said conductor cable are encased in an electrically isolating cover.

19. The vehicle body carrier of claim 12, wherein said isolator elements are constructed of an ultra high molecular weight (UHMW) plastic.

20. An electrically isolated vehicle body carrier for transporting a vehicle body through an electrodeposition coating bath with said vehicle body in an electrically charged state, comprising:

a carrier framework for supporting and retaining a vehicle body, said carrier framework suspended from an overhead conveyor and having at least one substantially hollow primary support member that extends substantially from a point of connection with said overhead conveyor to a point of support beneath a carried vehicle body;

a plurality of vehicle support/retention elements associated with said carrier framework for supporting and retaining a vehicle body on said carrier framework from a location beneath said vehicle body;

a conductor member associated with an upper portion of said carrier framework, said conductor member in temporary electrical communication with a source of electric current associated with a portion of said overhead conveyor;

a conductor cable connected to said conductor member and routed through said substantially hollow primary support member to a support/retention element in conductive contact with a vehicle body carried on said carrier framework; and isolator elements located between said carrier framework and all conductive points of contact between said carrier framework and said vehicle body;

whereby, said vehicle body is electrically charged by said electric current without electrically charging said vehicle body carrier.

21. The vehicle body carrier of claim 20, wherein said support/retention element to which said conductor cable is connected is a pin that enters an aperture in a vehicle body carried on said carrier framework.

22. The vehicle body carrier of claim 20, wherein portions of said conductor cable residing outside of said substantially hollow primary support member are encased in an electrically isolating cover.

23. The vehicle body carrier of claim 20, wherein said isolator elements are constructed of an ultra high molecular weight (UHMW) plastic.

* * * * *

UNITED STATES PATENT AND TRADEMARK OFFICE

CERTIFICATE OF CORRECTION

PATENT NO. : 8,192,593 B2
APPLICATION NO. : 12/410546
DATED : June 5, 2012
INVENTOR(S) : Penn It is certified that error appears in the above-identified patent and that said Letters Patent is hereby corrected as shown below:

On the title page, section (57), line 2 of the Abstract, please delete "electrode position" and insert -- electrodeposition --.

On the title page, section (57), line 14 of the Abstract, please delete "electrode position" and insert -- electrodeposition --.

Signed and Sealed this
Twenty-fourth Day of July, 2012

David J. Kappos

David J. Kappos
*Director of the United States Patent and Trademark Office*